United States Patent [19]

Furuya et al.

[11] Patent Number: 4,833,505

[45] Date of Patent: May 23, 1989

[54] LATENT IMAGE COLOR DEVELOPING SYSTEM

[75] Inventors: Nobumasa Furuya; Kazuo Maruyama; Tsuneo Noami; Takeshi Sumikawa; Toshirou Yamamoto; Kouji Adachi; Kiyoshi Horie, all of Kanagawa, Japan

[73] Assignee: Fuji Xerox Co., Ltd., Tokyo, Japan

[21] Appl. No.: 147,352

[22] Filed: Jan. 22, 1988

[30] Foreign Application Priority Data

Jan. 23, 1987 [JP] Japan ..... 62-12231
Apr. 13, 1987 [JP] Japan ..... 62-88626

[51] Int. Cl.[4] ..... G03G 15/01

[52] U.S. Cl. ..... 355/326; 355/251; 430/42

[58] Field of Search ..... 355/4, 3 DD, 14 D, 14 R, 355/3 R; 430/42, 31, 46, 55, 64, 67, 902

[56] References Cited

U.S. PATENT DOCUMENTS 4,335,194 6/1982 Sakai ..... 430/42
4,518,246 5/1985 Spitzner et al. ..... 355/4
4,599,285 7/1986 Haneda et al. ..... 355/4 X
4,682,880 7/1987 Fujii et al. ..... 355/4
4,746,952 5/1988 Kusuda et al. ..... 355/4
4,754,301 6/1988 Kasamura et al. ..... 355/3 DD

FOREIGN PATENT DOCUMENTS 55-36889 3/1980 Japan .
55-73063 6/1980 Japan .
56-162755 12/1981 Japan .
57-79970 5/1982 Japan .
60-126665 7/1985 Japan .
61-36767 2/1986 Japan .
61-36768 2/1986 Japan .
61-48871 3/1986 Japan .

*Primary Examiner*—A. C. Prescott
*Attorney, Agent, or Firm*—Finnegan, Henderson, Farabow, Garrett, & Dunner

[57] ABSTRACT

A latent color image developing system for copying a document having a first color images and second color images develops the first color images with a first color developer and the second color images with a second color developer. The second color developer includes a toner and a magnetic carrier having a density of less than 4.0 g/cm$^3$ and a particle size in the range of 30–50 microns. A developer roll is used having a main developing pole with a flux density of more than 500 gauss in a nip region proximate a photosensitive member having latent electrostatic images to be developed.

14 Claims, 8 Drawing Sheets

LATENT IMAGE COLOR DEVELOPING SYSTEM

FIELD OF THE INVENTION

This invention relates to a latent image color developing system. More specifically, the present invention relates to a color picture recording method for producing color toner images by developing without turbulence visual images (toner images) on latent image carriers. The present invention further relates to a copy machine that reproduces documents by using two colors—a specific color and another, optional color.

BACKGROUND OF THE INVENTION

Various color recording methods utilizing an electrophotographic method have been proposed. One of them is the repeated developing method. This method forms bi-value or tri-value electrostatic latent images on a photosensitive member, develops the first latent image by a first processor and then the second latent image by a second processor, and transfers the ultimately formed toner images to a copying paper at the same time to obtain a color picture.

This repeated developing method has a problem, however, in that the photosensitive member already carrying the toner image formed by the first developing process is rubbed again by the developer in the second developing process. As a result, the toner image formed by the first developing process is greatly disturbed in and after the the second process, leading to the extremely disturbed, i.e., smeared, final color picture. Therefore, it is very important in picture formation by the repeated developing method that the second state developing process be performed without disturbing the toner image formed at the first developing stage.

A developing method that would cause little disturbance of the toner image on the photosensitive member is conceivable which uses a single-ingredient developer for the second-stage developing process. In the single developer non-contact developing method, however, it is difficult to increase the developing speed and the method is not preferable in this respect to the magnetic brush developing method that uses the developer consisting of two components, i.e., a carrier and toner.

A two-ingredient developer, as is normally employed in the magnetic brush developing method, is composed of substances such as iron, ferrite, etc., which have a grain size of 80–120 microns. In the magnetic brush developing method using a two-ingredient developer, the developer is carried by a non-magnetic sleeve of a developing roll having magnet rolls therein and the latent image is developed by rubbing it with a magnetic brush. In order to obtain a sufficient developing density, it is necessary to set the ratio of the linear speed of the latent image carrier to the surface speed of the developing roll to be 1:3–4. This causes the problem that the toner image formed in the first developing process of the repeated developing method is rubbed and disturbed by the tip part of the magnetic brush in the second developing process.

To overcome these problems, Japanese Pat. Nos. 36889/1980 and 79970/1982 disclose methods wherein the rubbing force of the second magnetic brush device against the latent image carriers is made smaller than the rubbing force of the first magnetic brush device to reduce the toner scratch-off effect of the second magnetic brush. Namely, in the '889 patent, the surface movement linear speed of the developing roll of the second developing device is made equal to the surface speed of the latent image carrier. In the '970 patent, the magnetic flux density of the main pole magnet of the developing roll of the second developing device is made less than that of the first developing device to reduce the toner scratch-off effects. Further, Japanese Patent No. 126665/1985 proposes a color developing device, which uses a two-ingredient developer made of magnetic carriers with less than 50 micron grain size mixed with toner particles.

The device described in the '889 patent has the disadvantage that since the linear surface speed of the developing roll of the second image processor is equal to the surface speed of the latent image carrier, the second processor's developing ability is weakened and the developer concentration is lowered. The device described in the '970 patent has the drawback that the magnetic flux density of the main pole magnet of the developing roll of the second processor is too small (300–500 gauss) to develop images in a sufficiently high density. Further, in the device disclosed in the '665 patent, the use of the carriers with a smaller grain size has improved the image turbulence phenomenon, but a so-called "carry-over" phenomenon caused by the carriers moving from the processor to the photosensitive member surface becomes more prevalent as the carrier grain size becomes smaller. The magnetic force must be increased to avoid the carry-over phenomenon, and the carrier grain size must be increased to some extent to raise the magnetic force. Therefore, the control of the carrier particle diameter alone cannot produce satisfactory results.

Systems for developing latent color images have been embodied as color copier machines that reproduce pictures on a manuscript or other document by means of 3 kinds of color decomposing filters, such as, red (R), blue (B), and green (G) filters. The copier performs the reproduction process separately for each of these components of color images and superimposes the images on a copying paper to obtain an image of the original color picture.

In such a color reproduction machine or color copier, the precise registration of differently colored pictures on the copy paper is also necessary which complicates the construction and control system of the machine, enlarges its size, and increases its manufacturing cost. Moreover, multi-colored manuscripts or documents as are commonly duplicated are mostly composed of black letters, figures, and other markings with only a small percentage of underlines, marks, etc., being in red or other colors. Therefore the use of a full-color reproduction maching is extremely uneconomical for such documents. In a full-color copy machine, any black picture is expressed by the mixture of 3 colors, will not be purely black, and has lower reproducibility than if reproduced with a purely black toner. Further, letters included in the black picture part of a manuscript are mostly made of fine lines and become illegiblle if the registration is not precise.

Therefore, a bi-color copying machine using only black toner and a toner of another color would be more useful in reproducing many documents comprised mostly of black letters and pictures. It is desired that these black letters and pictures be equal in quality to those reproduced by a conventional monochrome copying machine. Further, in order that most documents composed of two colors may be reproduced, it is preferable that two or three different toner colors (red, blue, green, etc.) be individually selectable to be combined with black toner according to the circumstances.

Japanese Pat. Nos. 73063/1980, 36767/1986, 36768/1986, 48871/1986 and 162755/1981 disclose bi-color copying machines intended to meet the aforesaid requirements. The '063 patent describes a bi-color copying machine for forming electrostatic latent images of the letters and figures in black color and another specific color on a photosensitive member by using only an analog optical system. The analog optical system is a device that focuses photo images directly to the photosensitive member by means of mirrors and lenses. Such a device will hereinafter be called an "imaging optical system."

A copying machine of this type has the problem that a tri-value latent image having 3 levels of potential is actually formed, leading to the occurrence of hybrid colors at the latent image border by the fringe electric field and to the deterioration of black pictures compared with those reproduced by a conventional, monochrome copying machine. Further, the machine uses a special laminated photosensitive member capable of forming the tri-value latent image and has a complicated electrostatic latent image forming process, which increase its production cost.

The device disclosed in the '768 patent is intented to overcome these problems, and exposes two photosensitive members using an imaging optical system. One of optical systems is an ordinary photosensitive member and the other optical system is a laminated photosensitive member for forming the latent image corresponding to a specific color. The electric latent images on the first and second photosensitive members are developed by black toner and the toner of another specific color, respectively, and transferred one after the other onto a copying paper.

This method reduces the problem of deteriorated black pictures but has the inherent problem that since two differently colored images are transferred to a copying paper one after the other by two distinct operations, the machine must operate to register precisely the two images. This also leads to a higher cost. Also, the machine must be enlarged to accommodate both kinds of photosensitive members, and the use of a laminated photosensitive member complicates the reproduction process, and increases cost. Also, in the method to separate colors by a laminated photosensitive member, the colors to be separated are fixed according to the characteristics of the member, so it is impossible to increase the number of specific colors.

The system described in the '755 patent copies the black picture on a copying paper by the electronic reproduction process using an imaging optical system, and then extracts the picture in a specific color by an image sensor and additionally transfers it to the copying paper by a recorder with the electrostatic recording system. This method is more advantageous in the separation and reproduction of the specific color than the above-mentioned method using two imaging optical system, but requires highly precise registration as the picture in a specific color has to be superimposed on the black picture already formed on the copying paper. This makes the machine expensive and it must be large enough to accommodate the two kinds of independent imaging devices.

The '871 patent discloses the technology which forms the electrostatic latent images in several different colors, each image being formed on a different photosensitive member by a different imaging optical system, and transfers them to a copying paper one after another. This involves a complicated transfer process and has the problem of registration.

The device shown in the '767 patent uses two photosensitive members, forms the electrostatic latent images of the manuscript or document pictures on the photosensitive members by means of an imaging optical system, erases unnecessary parts from each latent image by an eraser, develops these images by different color developers, and transfers them to a copying paper one after the other. This method also requires high-precision registration because the transfer of the two pictures in different colors is made at a different place.

OBJECTS AND SUMMARY OF THE INVENTION

An object of the present invention is a latent image color developing system wherein a second image formed from a two component developer may be applied to a first toner image without disturbing the first toner image.

Another object of the present invention is a latent image color developing system that can reproduce images including both black portions having high resolution and color portions.

A further object of the present invention is a latent image color developing system that is simple in construction and relatively inexpensive.

These and other objects are achieved by a latent color developing device for reproducing on a medium an image of a document having a first color component and a second color component, comprising means for scanning the document and generating an electric picture signal corresponding to the image and including a first color signal component and a second color signal component, a photosensitive member, means for forming a first electrostatic latent image on the photosensitive member corresponding to the first color signal component, an imaging optical system for forming a second electrostatic latent image on the photosensitive member corresponding to the second color signal component, first developing means for developing the first electrostatic latent image with a toner of a first color, second developing means for developing the second electrostatic latent image with a toner of a second color, and means for transferring the developed first and second latent images to the medium.

The objects are further accomplished by a latent color image method comprising the steps of forming electrostatic latent images on a latent image carrier, developing a first set of the latent images in a first developing process with a first developer having a first toner of a first color, developing a second set of the latent images in a second developing process comprising the substeps of providing a magnetic pole having a flux density greater than 500 guass proximate the latent image carrier, providing a non-magnetic sleeve around the magnetic pole, applying to the non-magnetic sleeve a two-component developer including a second toner of a second color and a magnetic carrier having a density less than 4.0 g/cm$^3$ to devlop the second set of latent images, and transferring to a copy medium the developed first and second sets of latent images.

BRIEF DESCRIPTION OF THE DRAWINGS

The manner by which the above objects and other objects, features, and advantages of the present invention are attained will be fully apparent from the following detailed description when it is considered in view of the drawings, wherein:

FIG. 1 is operated;

DETAILED DESCRIPTION

Figure 1:
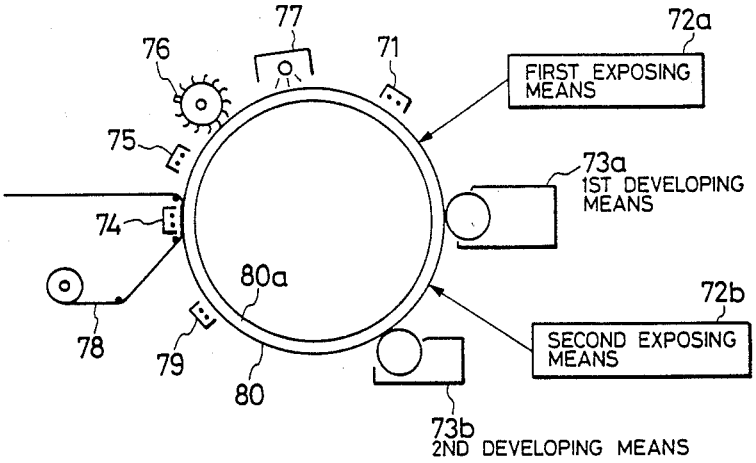
FIG. 1 shows an outline of an example of the latent image color developing system according to the present invention.

The density of the carriers used in a two-ingredient developer is an important factor in the degree of turbulence of the toner image. The inventors have found that better results could be obtained when the main developing pole of the developing roll provides a repulsion magnetic field with a specific magnetic flux density.

In the latent color image developer system of the present invention, a latent image formation process forms electrostatic latent images on latent image carriers by means of latent image forming means. The electrostatic latent images are developed by means of toners in two or more different colors and in a transfer process, the latent image forming process and the developing process, or at least the developing process is repeated several times followed by transferring the developed color toner images onto a copying material. This system includes a developing roll that includes a developing sleeve and a magnet roll, which has magnetization patterns where two magnetic fields with the same polarity are located adjacent with each other in the developing nip region, and a magnetic flux density greater than or equal to 500 gauss for the main developing pole is used at least in the second and subsequent developing processors. Developing is accomplished by means of a two-ingredient developer comprising a toner mixed with a magnetic carrier having a density less than 4.0 g/cm$^3$ density.

As for the carriers used in the system of the present invention, materials such as carriers with a porous surface, ferrite carriers, carriers having magnetic powder dispersed in a binding resin, etc., can be used, provided that their density is less than 4.0 g/cm$^3$. Carriers with magnetic powder dispersed in a binding resin are preferable as their density is easily controlled by the volume of magnetic powder contained in the binding resin. One experiment has revealed that if the density d is within the range of d=1.7−4.0 g/cm$^3$, or preferably d=1.7−3.0 g/cm$^3$, the picture turbulence and carry-over phenomena can be reduced to within allowable limits. This is possibly attributed to the fact that since individual carriers have small density, the tip part of the magnetic brush becomes softer.

The average grain size of the low-density carrier particles according to the present invention is preferably in the range from 30 to 50 microns, expecially about 40 microns. If the average grain size is out of the above range, it becomes difficult to prevent carry-over phenomenon while at the same time preventing the image turbulence phenomenon.

The density of the carriers according to this invention can be defined by the density obtained from the true specific gravity measured by the following measurement method. The true specific gravity is determined by the following formula using the auto-true denser MAT-5000 (mfd. by Seishin Kigyo Co., Ltd.), which is an automatic measuring instrument that employs the so-called pycnometer method (the true specific gravity bottle method) that determines the true specific gravity by completely replacing all the clearance among the powders with a liquid and applying the formula below to the relations between the weight and volume of the liquid.

$$Pd = \frac{Wb - Wa}{Wb - Wa - Wc + Wd} \times Ld, \text{ where}$$

Pd: true specific gravity, Ld: specific gravity of the liquid, Wa: tare of the cell (empty cell) (g), Wb: the tare of the cell+powder (g), Wc: the tare of the cell+power+liquid (after the liquid level is determined) (g), Wd: the tare of the cell+liquid (after the liquid level is determined) (g).

The magnetic brush device used in the devloping process according to the system of the present invention has a developing roll that consists of a magnet roll with a plurality of magnetic fields and a non-magnetic cylindrical sleeve provided at the circumference of the magnet roll. The developing roll used at least in the second and subsequent developing processors preferably has a magnetization pattern where the magnetic fields with the same polarity are located adjacent to each other in the developing nip region, and the magnetic flux density of the main developing pole must be more than 500 gauss. Further, the difference between the top and bottom of the magnetic flux distribution of the main developing pole should be more than 200 gauss, most desirably 350–500 gauss.

Figure 3:
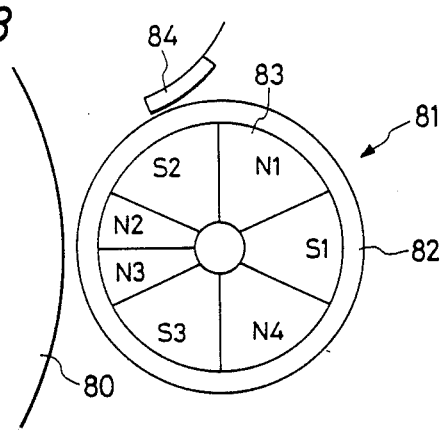
FIG. 3 illustrates an embodiment of a developing roll used in the system of the present invention.
Figure 4:
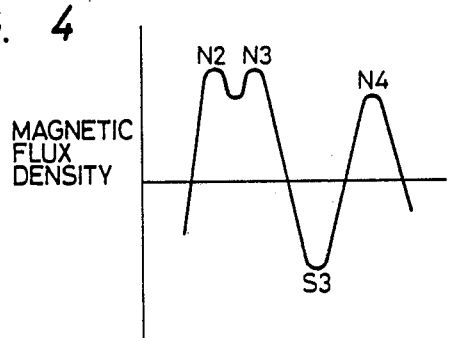
FIG. 4 is a graph of the magnetic flux density of the developing roll of FIG. 3.

In FIG. 3, the developing pole 81 consists of a developing sleeve 82 made of non-magnetic material and magnet roll 83 forming a 7-pole asymmetrical magnetization pattern and being provided opposite to a photosensitive drum 80. The main developing poles are N2 and N3, which are adjacent to each other and form the repulsion magnetic field of the developing nip as shown in FIG. 4. Numeral 84 represents the tip control member.

During development a two-ingredient developer is held on the developing sleeve 82 of the developing roll 81. The tip length is adjusted by the tip control member 84 to form the magnetic brush, which is moved by the relative movement of the magnet roll 83 and sleeve 82, rubs the surface of the photosensitive member 80 located opposite to it and attaches a toner to the electrostatic latent images thereon to develop the images. In this operation, the magnet roll 83 is fixed and the sleeve 82 is rotated. Its surface movement linear speed is preferably equal to the surface movement speed of the photosensive member 80, i.e., the latent image carrier.

Figure 2:
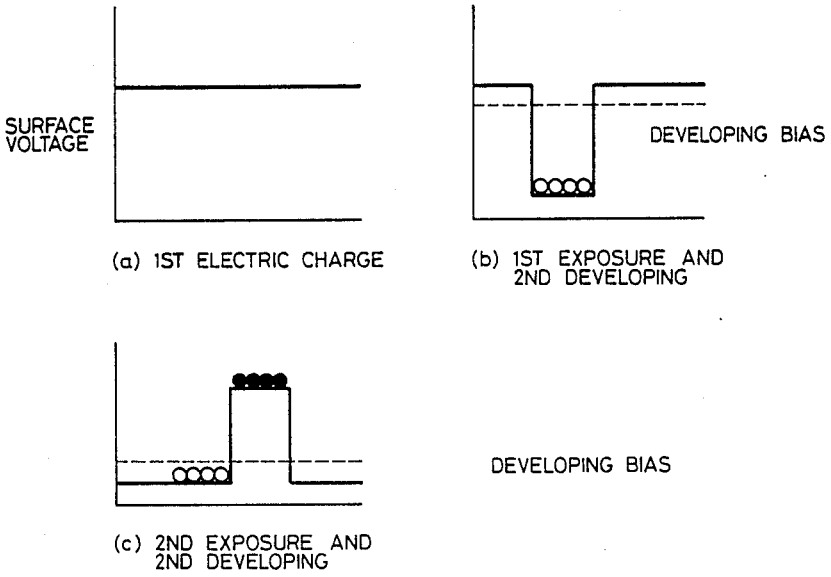
FIG. 2 illustrates the surface potential of a photosensitive member and the developing conditions when the color developing system os

FIG. 1 shows an example of the latent image color developing system according to the present invention, where a color picture is formed by forming and developing a bi-value latent image. FIG. 2 illustrates the surface potential of the photosensitive member and the developing conditions when the color picture recording device in FIG. 1 is operated. In FIG. 1, numeral 71 denotes an electrifier, 72*a* a first exposing means, 73*a* a first developing member, 72*b* a second exposing means, 73*b* a second developing means, 74 a transfer corotoron, 75 a pre-clean corotoron, 76 a cleaner, 77 an optical pre-clean device, 78 recording paper, 79 a pre-transfer corotoron, 80 the photosensitive drum, and 80*a* the photosensitive layer.

The photosensitive drum 80 is rotated in the clockwise direction. The photosensitive layer 80*a* on the surface of the photosensitive drum 80 is uniformly electrified by the electrifier 71 (FIG. 2(*a*)).

Next, the first exposing means 72*a* irradiates light according to the picture information corresponding to the first color, and an electrostatic latent image corresponding to the first color is formed on the photosensitive member 80. Any kind of exposing member can be selected and used. The first developing means 73*a* then supplies the toner corresponding to the first color to the photosensitive layer 80*a* having the first electrostatic latent image formed thereon by the first exposing means, in order to develop the latent image (FIG. 2(*b*)). Any type of developing means can be used as the first developing means 73*a*. The developing bias depends on whether regular or reversal developing is performed.

Subsequently, the second exposing means 72*b* irradiates light according to the picture information of the second color and forms an electrostatic latent image corresponding to the second color on the photosensitive layer 80*a*. Any type of exposing means and imaging method can be adopted and used. Toner corresponding to the second color is then supplied from the second developing means 73*b* to the photosensitive layer 80*a* having the second electrostatic latent image formed thereon by the second exposing means (FIG. 2(*c*)). The developing bias can be arbitrarily selected.

The pre-transfer corotoron 79 is used before the transfer process to adjust the polarity of the 1st and 2nd toners carried by the photosensitive member 80. This step can be omitted from the developing process. The 1st and 2nd toner images are transferred onto the recording paper 78 by means of the transfer corotoron 74, but they can also be transferred in a way other than the elctrostatic transfer method. The recording paper is fixed in a fixation section (not shown). The photosensitive member 80 is cleaned by the pre-clean corotoron 75, the cleaner 76, and the optical pre-cleaner 77 in order to be used again.

The 1st and 2nd exposing means each consist of a light illuminating means, a document scanning means, and an imaging optical system as used in the ordinary copying machine. They can be replaced with any light imaging device capable of transmitting picture information by optical modulation. Other devices that could be used are a laser imaging device, a liquid crystal light bulb including a uniform light source-liquid crystal microshutter, an LED array, an optical fiber, etc. Further, the second electrifier may be provided in front of the 2nd exposing means according to circumstances.

An embodiment according to the present invention will be further described below, as implemented with an example of a two-ingredient developer.

Carrier

Stylene-n-butylmethacrylate copolymer (density: 1.1 g/cm$^3$) was mixed with cubic-type magnetite (density: 4.8 g/cm$^3$) at a weight ratio of 20:80, melted and mixed, and finely crushed to obtain the carrier with a density of 2.9 (g/cm$^3$) and an average grain size of 49 microns.

Toner

A 92 weight part of the resin obtained through a graft polymerization of stylene-butylmethacrylate copolymer and low-molecular polyolefin was mixed with a 8 weight part of a red pigment (the tradename: Risorscalt mfg. by BASF, Inc.), melted and mixed, finely crushed to obtain the toner with an average grain size of 9.8 microns Two-ingredient developer A 90 weight part of the above carrier and a 10 weight part of the above toner were mised with each other to obtain the developer for use in the system of the present invention. Details of some tests conducted with the latent color image developing system shown in FIG. 1 will now be described.

A Se based photosensitive drum was used in the test, and was uniformly electrified to 1,100 V by an electrifier. A reversal exposure (exposing the picture part) was made by a He—Ne laser to form an electrostatic latent image having a surface potential of 200 V at the exposed part and 800 V at the non-exposed part. The latent image was developed by the first developing means 73*a* using a red toner at the developing bias of 650 V. The regular exposure (exposing the non-picture part) using an exposurre lamp was performed to form an electrostatic latent image with a surface potential of 750 V at the non-exposed part and 100 V at the exposed part. The latent image was developed by the 2nd developing means 73*b* using a black toner at the developing bias of 250 V. The other test conditions were as follows.

The surface movement linear speed of the photosensitive drum was set at 50 mm/sec. The two-ingredient carrier used by the 1st and the 2nd developing means had a density of 3.0 g/cm$^3$, a 40 micron average grain size, and was made of magnetic powder dispersed in a binding resin.

The developing roll of the 1st developing means 73*a* was a 6-pole symmetrical magnetization developing roll, and the magnetic flux density of its main pole magnet was 800±50 gauss. The developing roll of the 2nd developing means 73*b* was a 7-pole assymmetrical magnetization developing roll rotated at a surface movement linear speed of 50 mm/sec. The surface magnetic flux density of both the main pole magnets N2 and N3 was 1,200±50 gauss, and the level difference between the top and bottom magnetic flux density distributions formed by N2 and N3 was 500 gauss. Further, the magnetic flux density of the other poles in the developing roll was 800±50 gauss.

Test 2 was made under the same test conditions as Test 1 except that an iron-based carrier with a density of 7.8 g/cm$^3$ and an average grain size of 50 microns was used in the two-ingredient developer for the 2nd developing means 73*b* for the purpose of comparison with Test 1.

Figure 5:
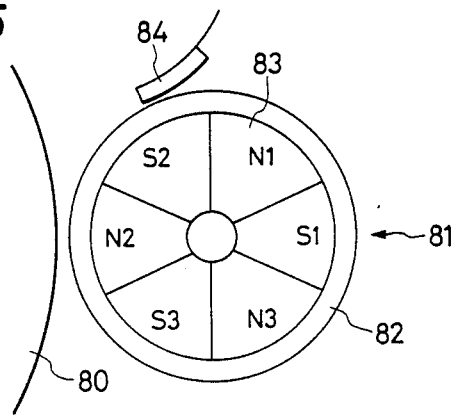
FIG. 5 illustrates another embodiment of a developing roll.

Test 3 was conducted under the same test conditions as Test 1 except that an iron-based carrier with a density of 7.8 g/cm$^3$ and an average grain size of 60 microns was used as the carrier of the two-ingredient developer, the 6-pole symmetrical magnetization developing roll (the surface magnetic flux density of the main pole magnet N2=800±50 gauss) shown in FIG. 5 was used, and the surface movement linear speed was set at 150 mm/sec., i.e., the speed was increased to three times that used in Test 1 to obtain an equal developing density as that of the repulstion magnetic field.

Test 4 was carried out under the same test conditons as Test 1 except that the surface magnetic flux density of the main pole magnets N2 and N3 was 300±50 gauss and the level difference between the top and bottom of the magnetic flux density distribution of N2 and N3 was 100 gauss.

The result of these tests is shown in the table below, in which the letter N means "No", the letter Y means "Yes" and the dash mark (—) indicates that the picture was deteriorated and not practicable.

| | The 1st developed picture deterioration | | The 2nd developed picture |
|---|---|---|---|
| Test No. | Turbulence | Reduced concentration | Reduced concentration |
| 1 | N | N | N |
| 2 | N | — | N |
| 3 | — | Y | N |
| 4 | N | N | — |

As is clear from the results in the above table, the developing ability is not lowered, but the existing toner image scrape-off effects can be reduced by using the developing roll having a repuls on magnetic field in the developing nip region at the second developing stage. In this case, it is necessary that the magnetic flux density of the repulsion magnetic field in the developing nip region should be more than 500 gauss, and the level difference between the top and bottom of the magnetic flux density distribution in the developing nip region should be more than 200 gauss. If these requirements are met, the developing ability can be fully displayed. It can also be seen from the table that the effects to prevent the deterioration of the toner image produced by the 1st developing process are remarkable when the above-mentioned developing roll and the two-ingredient developer containing the magnetic carrier with a density of less than 4.0 g/cm$^3$ are used in combination.

In the latent color image developing system according to the present invention which performs repeated development by the magnetic brush method by means of the above-mentioned developing roll and a two-ingredient developer, the toner image formed at the first stage is not disturbed by the repeated developing, nor does the carry-over phenomenon occur. Therefore, the color pictures obtained by this system are good in quality without any turbulence.

The latent color image developing system can be embodied in a copying machine that comprises a picture reading device which reads a picture from a manuscript and converts it into electric picture signals, an optical output device that forms on a photosensitive member a first electrostatic latent image corresponding to specific color signal components of the picture signals, an imaging optical system that forms on the photosensitive member a second electrostatic latent image comprising a photo-image of another color component of the picture signals, a first processor that develops the first electrostatic latent image by a first-color toner, a second processor that develops the second electrostatic latent image with another color toner, and a transfer device that transfers the toners onto a copying paper after the development by the first and second processors. Such a recording device or copying machine forms on a photosensitive member the electrostatic latent image for a specific color by means of an optical output device, and the latent image for the other color by means of an imaging optical system. These electrostatic latent images are developed by different processors using different-colored developers.

For instance, when the electrostatic latent image for a black picture is formed by the imaging optical system, this image is developed by black toner. The electrostatic latent image for the picture, in a specific color other than black, is formed by the optical output device and developed by a toner with a specific non-black color. In this way, toner images in two different colors are formed on the photosensitive member and transferred onto a copying paper at once.

Figure 6:
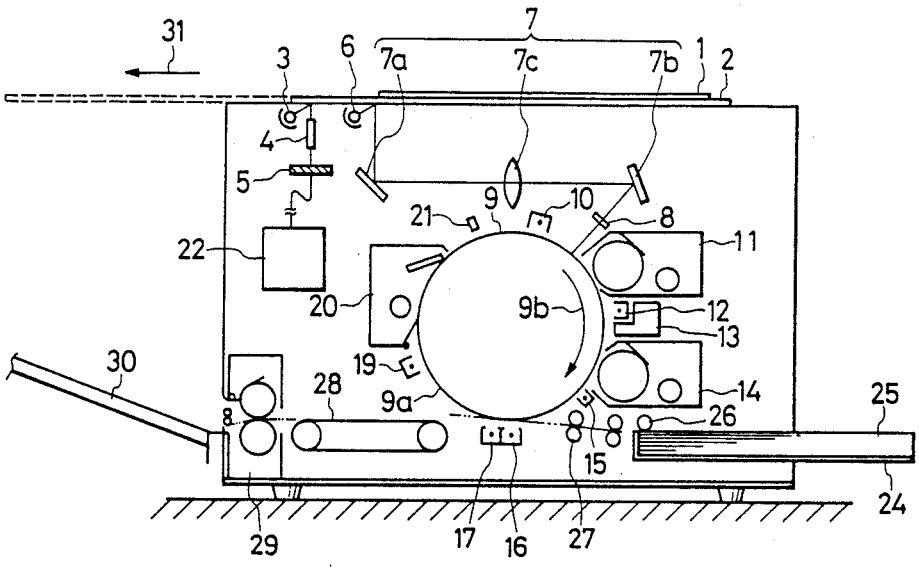
FIG. 6 shows a schematic construction of an embodiment of a color copying machine based upon the system of the present invention.

FIG. 6 shows a schematic view of the construction of an embodiment of the copying machine for implementing the system of the present invention. This device consists of a platen glass 2 that carries a document 1, a lamp 3 for irradiating the picture on the document, a picture reading device 5 that reads the picture through a convergent lens 4 and converts it into an electric picture signal, a second lamp 6 for irradiating the document 1, an optical system 7 consisting of mirrors 7*a* and 7*b* a lens 7*c* for transmitting the photo-image corresponding to the picture on the document, and an optical filter 8.

The photosensitive drum 9 includes a photosensitive surface of member 9*a* at its periphery and is rotated in the direction of arrow 9*b*. Opposite the surface 9*a* are arranged a 1st electrifier 10, the 1st developing means or processor 11, a 2nd electrifier 12, an optical output device 13, a 2nd developing means or processor 14, a pre-transfer treatment corotoron 15, a transferer 16, a peel-off corotoron 17, a pre-clean corotoron 19, a cleaning device 20, and a pre-clean lamp 21. The picture signal output from the picture reading device 5 is processed by a signal treatment circuit 22 that is connected to the optical output device 13 to operate according to a specific color component signal of the picture signal selected by the signal treatment circuit 22. The physical connector between the signal treatment circuit 22 and the optical device 13 is not shown.

This device is provided with a paper supply tray 24 accommodating copying paper sheets 25, paper feed rollers 26, carrying rollers 27, a carrying belt 28, a fixer 29, and a discharge tray 30.

In this device, two kinds of electrostatic latent images are formed on the photosensitive member 9*a* by the imaging optical system 7 and the optical output device 13. The electrostatic latent image formed by the optical output device 13 is called the 1st electrostatic latent image, and the image formed by the imaging optical system 7 is called the 2nd electrostatic latent image.

In this embodiment, the photo-image produced by the imaging optical system 7 passes through the optical filter 8, such as a well red filter, and reaches the photosensitive member 9*a*. In such an instance, the red light reflected from the red image in the picture on the document reaches the photosensitive member 9a with an intensity similar to that of light reflected from the white background of the picture. By what is called positive imaging, no electrostatic latent image corresponding to the red image is formed, i.e., (it is pre-cleaned like the background), but a latent image corresponding to the portion of the image of the other color, e.g., black, is instead formed.

On the other hand, the picture signal read by the picture reading device 5 contains all the color components. Only the signal corresponding to the red image is separated and extracted by the signal treatment circuit 22. The optical output device 13 is operated in response to the extracted signal and an electrostatic latent image corresponding to the red image is formed on the photosensitive member 9a through negative imaging.

The picture reading device 5 may be a primary solid-state image element consisting of a CCD (charge coupled device), etc., and three color filters (red (R), green (G) and blue (B) or cyan (C), megenta (M) and yellow (Y)) arranged in order at its light receiving surface to form a so-called color image sensor.

This picture reading device 5, when the document 1 is scanned in the direction of arrow 31, operates to photoelectrically convert the picture on the document scan line by scan line at the same speed as the scanning speed, and output the picture signals of each color component to the signal treatment circuit 22 one after another.

The signal treatment circuit 22 extracts the signal of a specific color component fromt the picture signals and operates the optical output device 13. For this purpose, it compares every picture element of the three picture signals (e.g., R, G and B) obtained through the color filters on the light receiving surface of the picture reading device 5 with one another to judge whether the picture element is red or not. If the circuit 22 determines it is red, it lights up the luminous element of the optical output device 13 to pre-clean the photosensitive member. In this case, negative imaging is adopted to enable it to develop the red picture element by red toner.

Another picture signal extraction method in the signal treatment circuit 22 is to address the color space. To do this, the coordinates where the strength of the R signal (red component signal) for a picture element is shown on the X-axis and the strength of G signal (green component signal) for the picture element is shown on the Y-axis, and the coordinate position of the picture signal is determined. If this position is located within a pre-set region corresponding to the red component, the picture signal is judged as red, and if this position is located in the other region, the picture signal is judged as not red. This operation is repeated on all the picture signals read. In this way, the red picture signal component can be extracted.

Various known devices such as a luminescent diode array, liquid crystal micro-shutter array, flourescent display tube array, magnetoptical shutter array, semiconductor laser scanner, etc., can be used as the optical output device 13.

Figure 7:
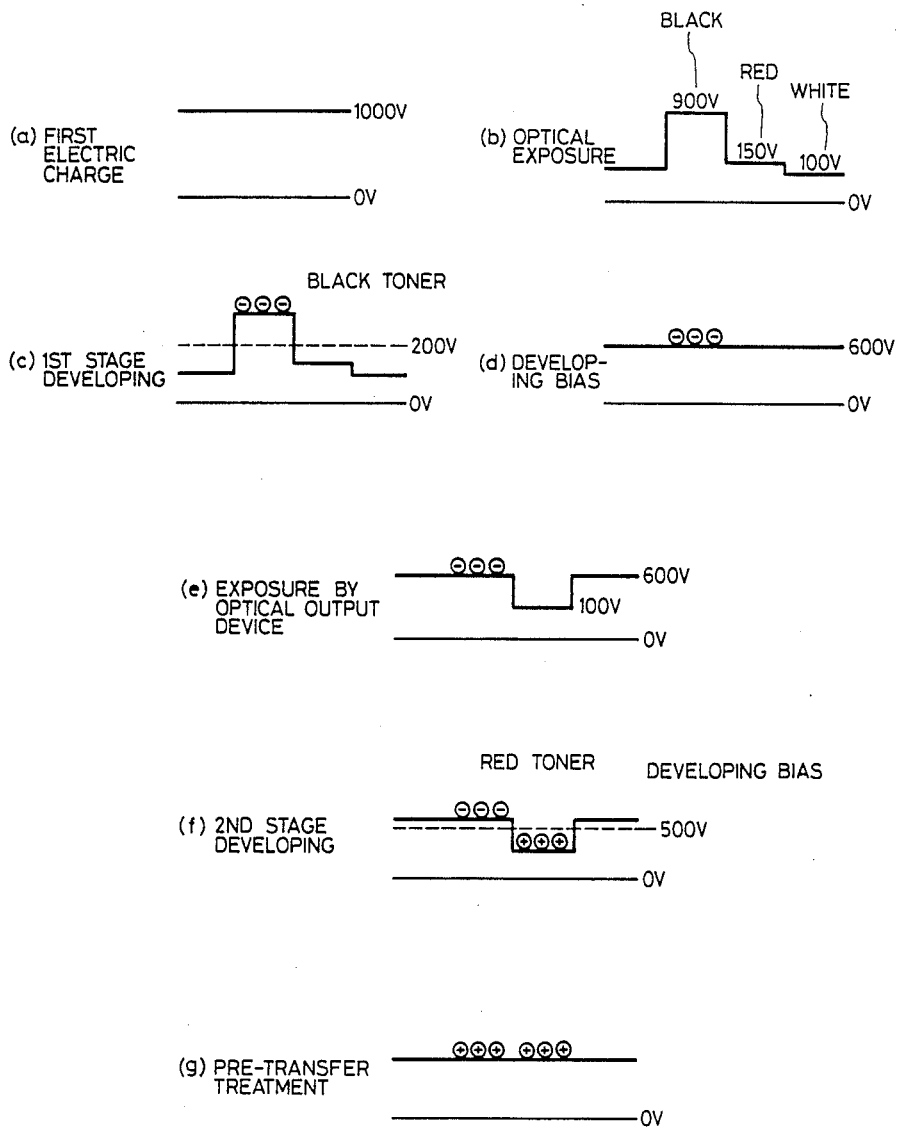
FIG. 7 is an illustration of the operation of the color copying machine of FIG. 6.

According to this invention, the 1st electrostatic latent image formed by the optical output device 13 and the 2nd electrostatic latent image formed by the imaging optical system are superimposed. The following method has been adopted for the formation and development of these latent images as shown in FIGS. 6 and 7.

In FIG. 6, when the platen glass 2 carrying the document 1 is moved in the direction of arrow 31, the 1st and 2nd electrostatic latent images are formed on the photosensitive member 9a, as explained above, as two kinds of electrostatic latent images.

The photosensitive member 9a rotates in the direction of arrow 9b, in a manner synchronized with the movement of the platen glass 2. After the surface of the member 9a is cleaned by the pre-clean corotoron 19 and the cleaning device 20, the photosensitive member 9a has unnecessary electric charge removed by the pre-clean lamp 21. Then the member 9a is primarily electrified up to about 1000 V by the 1st electrifier 10 (FIG. 7a), and the 2nd electrostatic latent image is formed by the optical system 7. In the 2nd electrostatic image, the electric charge on the red and white parts is reduced to 100–150 V, whereas the surface potential of the black part is kept at about 900 V (FIG. 7b). This latent image is developed by the processor 11.

The processor 11, in the first-state developing, develops the electrostatic latent image with a black toner with a negative polarity (FIG. 7c) and with a developing bias of about 200 V. The 2nd electrifier 12 electrifies the surface of the photosensitive member 9a again to 600 V (FIG. 7d), using a corotoron.

Subsequently, the 1st electrostatic latent image is formed by the optical output device 13, by reducing the areas corresponding to the red picture to a surface potential of about 100 V (FIG. 7e). Then the processor 14 causes the reversal developing of the electrostatic latent image by means of the red toner with positive polarity (FIG. 7f). The developing bias at this time is set to be about 500 V.

In this embodiment, the processor 11 is equal to the second processor and the processor 14 to the first processor. This embodiment adopts the repeated developing method using the first and the second processors. In this method, some image turbulence, toner mixing, etc., would normally occur but is prevented by using the two-component developer as described above. In this way, the images formed by black and red toners are developed on the photosensitive member 9a, and the polarity of the toners is adjusted to the positive polarity by the pre-transfer treatment corotoron 15 (FIG. 7g).

The copying paper 25 is fed from the paper feed tray 24 by the paper feed roller 26 and sent into the transferer 16 by the carrying rollers 27. The toner images in two colors are transferred onto the copying paper 25 at the same time, peeled off by the peel-off corotoron 17, and carried to a fixer 29 by a carrying belt 28. Finally, the copying paper 25, which has undergone the fixation process by the fixer 29, is discharged to a discharge tray 30.

The above process has an advantage in that since the picture formed from two colors is transferred at the same time, the precision of registration is not as important as in the case where they are separately and repeatedly copied. Further, regarding the black picture, the electrostatic latent image is formed by an imaging optical system and can have the same high quality as the black picture reproduced by a conventional copying machine.

The picture reading device 5 explained in reference to FIG. 6 is what is called a color image sensor, which makes the photoelectric conversion of each picture element by means of the filters in three different colors. Such a device, however, has a sensitivity that is lower than a monochrome image sensor.

Figure 8A:
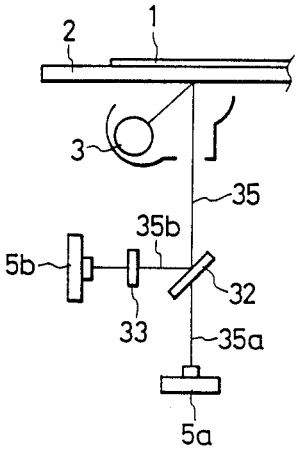
FIGS. 8(*a*) and 8(*b*) illustrate two embodiments of a picture reading device of the color copying machine of the present invention.
Figure 8B:
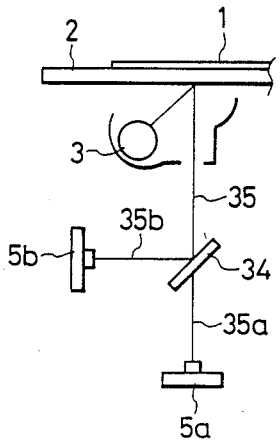

To solve this problem, the document 1 may be irradiated by the light source 3 as illustrated in FIG. 8(*a*) and the reflected light 35 may impringe on a half-mirror 31. Reflected light 35*a* is transmitted through the half-mirror 31 and is received by the first document reading device 5*a*. Another portion of the reflected light 35 is reflected from the half-mirror 32 and is received by the second document reading device 5*b* after transmission through a red filter 33.

The two document reading devices 5*a* and 5*b* comprise a monochrome image sensor without the color filters. The red color component of the picture signals can be extracted by comparing and processing the output signals from the devices 5*a* and 5*b*. Further an ND filter (a gray filter) may be inserted into the document reading device 5*a* to adjust the level of the input light.

A dichroic mirror 34 may be substituted for the half-mirror 32 and the filter 33 as shown in FIG. 8(*b*). As is well known, the dichroic mirror 34 decomposes the input light into the specified color components and sends them to the document reading devices 5*a* and 5*b*. The use of a dichroic mirror makes it possible to input different color components to the document reading devices 5*a* and 5*b*, and to extract only the red or other color component by comparing the color components.

Figure 9:
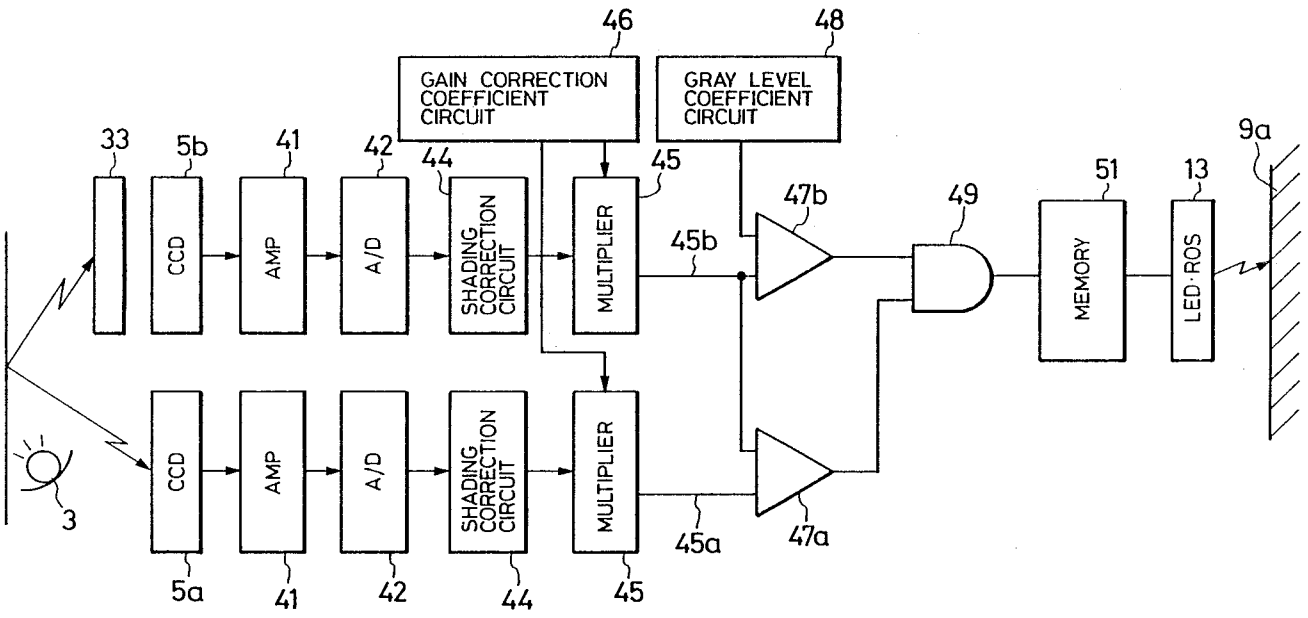
FIG. 9 is a block diagram of a signal treatment circuit of the color copying machine of the present invention.

FIG. 9 shows a block diagram of the picture signal treatment circuit 22. This circuit has the function that the lamp 3 irradiates the document 1, from which the reflected light is directly received by the first document reading means 5*a* and indirectly received by the second document reading means 5*b* through the red filter 33. The optical output device 13 forms the electrostatic latent image of the red-color picture on the photosensitive member 9*a*. These operations may be controlled by a microprocessor (not shown).

The picture signals photoelectrically converted by the document reading means 5*a* and 5*b* are amplified by respective amplifiers (AMP) 41, converted into respective digital signals by the analog/digital (A/D) converters 42 and corrected for output variations by known shading correction circuit 44.

Next, the difference of signal levels which has occurred by the different sensitivity to colors between the document reading means 5*a* and 5*b* is adjusted by the multiplier 45. The correction coefficient is supplied from the gain correction coefficient circuit 46. After their levels are adjusted, the red signal 45*b* and the black-and-white signal 45*a* are compared with each other by a digital comparator 47*a*. This comparator gives a high level output if the red signal 45*b* has a level higher than the level of the black-and-white signal 45*a*.

The level of the red signal 45*b* is compared with the standard value output from the gray level coefficient circuit 48 by the other digital comparator 47*b*. This circuit is provided to insure that any red picture above a certain thickness level should be reproduced as a black picture. Therefore, if the red signal is thicker than a certain thickness, the comparator 47*b* gives a low level output.

The AND circuit 49 sends to the memory 51 a high-level signal for reproducing the red picture when both comparators 47*a* and 47*b* have given a high-level output. The memory 51 accumulates the picture signals (each represents one-scan line of information on the document) outputted from the picture reading devices 5*a* and 5*b*, sends them to the optical output device (LED. ROS) 13 at certain time intervals and operates the device 13. By the above system, the red signal component is extracted from the picture signal and the first corresponding electrostatic latent image is formed.

Figure 10:
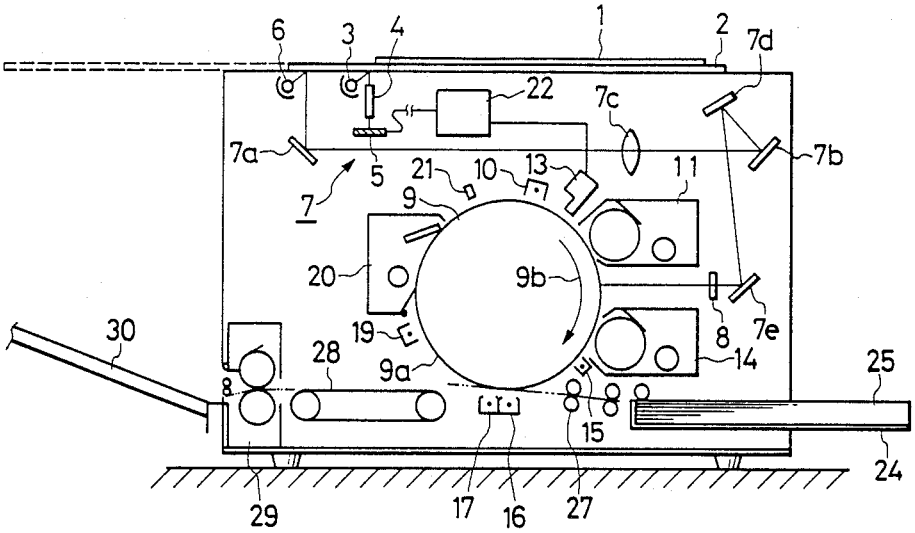
FIG. 10 is an illustration of another embodiment of a color copying machine according to the present invention.

FIG. 10 shows an embodiment of a copying machine for implementing the latent color image developing system of the present invention.

In this embodiment, the formation of the first electrostatic latent image using the picture signal output from the picture reading device 5 is made prior to the formation of the second electrostatic latent image by the imaging optical system 7 comprising the four mirrors 7*a*, 7*b*, 7*d* and 7*e*, and the lens 7*c*.

The negative imaging of the first electrostatic latent image is performed by the optical output device 13 against the photosensitive member 9*a* which has been uniformly electrified by the first electrifier 10. The processor 11 reversely develops the latent image using red toner with positive polarity.

Subsequently, the second electrostatic latent image is formed through positive imaging by the imaging optical system 7, in a manner that omits the re-electrification of the photosensitive body as in the embodiment in FIG. 6. The processor 14 develops the second latent image by means of toner with negative polarity. In this modification, the processor 11 is equal to the 1st processor and the processor 14 to the 2nd processor. Toner images in two colors can also be formed on the photosensitive member 9*a* by this method.

In the embodiment shown in FIGS. 6 and 7, the picture on the document is divided into black and red components, which are developed by a black toner and a red toner, respectively.

If a different color toner is used in each of several processors, however, it is possible to reproduce the picture composed of any two colors. The black picture may, for example, be developed by a blue toner. Further, the optical filter 8 may be changed to one of a different color. On the other hand, if the color component signals to be derived from a picture signal in the signal treatment circuit 22 can be freely selected, and if the toner colors in the processors 11 and 14 can be freely chosen, the copying machine can be used for reproducing documents printed in any two colors, such as black and blue, or black and green, besides a document to be printed in black and red.

Figure 11:
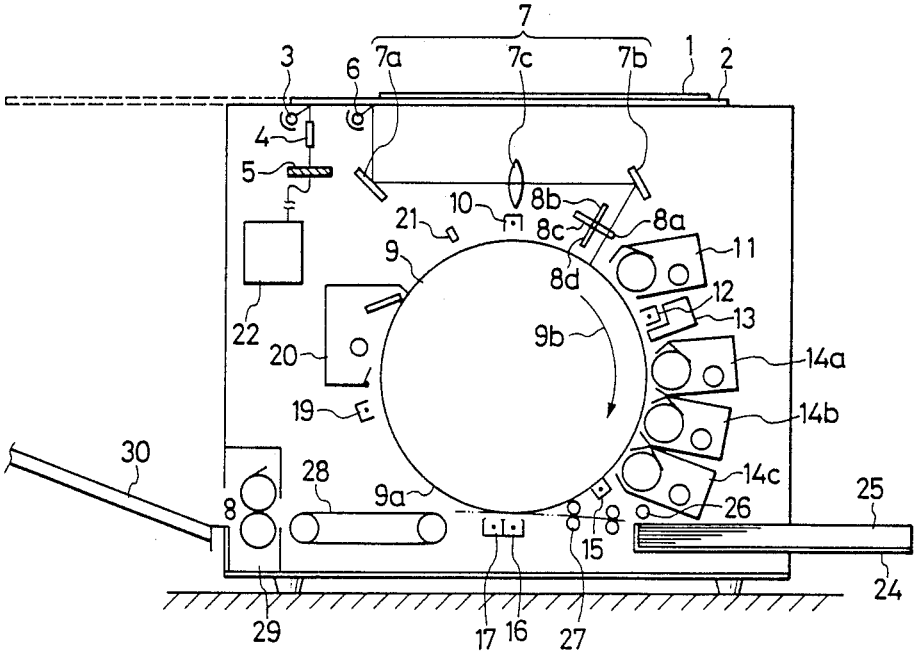
FIG. 11 is an illustration of still another embodiment of the color copying machine according to the present invention.

FIG. 11 shows an embodiment of copying machine to implement such functions. This copying machine is constructed to perform in the signal treatment circuit 22 three kinds of color extraction modes, e.g., red-color component, blue-color component and green-color component, and is provided with the circuit as shown in FIG. 9 for each color component.

The imaging optical system 7 has four kinds of color filters 8*a*, 8*b*, 8*c* and 8*d* which can be changed by being rotated. Filter 8*a* represents the red ND filter to adjust the red light volume, and filters 8*b*, 8*c* and 8*d* are blue, green, and gray ND filters, respectively, for adjusting the respective color light volumes. Further, three processors 14*a*, 14*b*, and 14*c* containing red toner, blue toner, and green toner, respectively, are provided to develop the first electrostatic latent image formed by the optical output device 13.

In the system with the aforesaid construction, when the picture on the document 1 is composed of black and blue colors, instructions are given to the signal treatment circuit 22 to extract the blue signal. As a result, the blue filter 8*b* is inserted into the optical system 7 and only the processor 14*b* is operated to develop the latent image with the blue toner. In this way, a duplicate picture in black and blue colors can be obtained.

In order that the reproduction of pictures composed of such various sets of two colors may be formed favorably, it is preferable to use a 3-wavelength type fluorescent lamp that covers the required spectral sensitivity region. A daylight type fluorescent lamp, a white-color type fluorescent lamp, or a xenon lamp may be used as the lamp 3 for irradiating the document. The same effects can of course be produced by using not only the color image sensor but also two sets of black-and-white image sensors, as shwon in FIGS. 8(*a*) and 8(*b*), to change the filters.

In the copying machine according to the latent color image developing system of the present invention, as mentioned above, the electrostatic latent images for two different colors are formed on a photosensitive member by an imaging optical system and a picture reading device. The images are separately developed by differently colored toners and transferred onto a copying paper at once. This method requires only a single transfer to the copying paper and does not require a high degree of precision in image registration. The electrostatic latent image of the black or other main color component is formed by an imaging optical system, that permits the high quality reproduction of pictures.

What is claimed is:

1. A latent image color developing device for reproducing on a medium an image of a document having a first color component and a second color component, comprising:

means for scanning the document and generating an electric picture signal corresponding to the image and including a first color signal component and a second color signal component;

a photosensitive member;

means for forming a first electrostatic latent image on said photosensitive member corresponding to said first color signal component;

an imaging optical system for forming a second electrostatic latent image on said photosensitive member corresponding to said second color signal component;

first developing means for developing said first electrostatic latent image with a toner of a first color;

second developing means for developing said second electrostatic latent image with a toner of a second color; and means for transferring said developed first and second latent images to the medium.

2. A latent image color developing device according to claim 1, further including:

third developing means for developing said second electrostatic latent image with a toner of a third color; and means for selecting said second developing means or said third developing means to develop said second electrostatic latent image with said second color toner or said third color toner, respectively.

3. A latent image color developing device according to claim 1, wherein one of said first color toner and said second color toner includes a carrier having a density of less than 4.0 g/cm$^3$.

4. A latent image color developing device according to claim 3, wherein said carrier is magnetic.

5. A latent image color developing device according to claim 1, wherein said first developing means comprises:

a magnetic core comprising a seven-pole magnet having an assymmetrical pattern, said magnetic core including a main developing pole including first and second adjacent pole elements of the same polarity opposite said photosensitive member; and a non-magnetic sleeve surrounding said magnetic core.

6. A latent image color developing device according to claim 5, wherein said main developing pole has a flux density greater than 500 gauss.

7. A latent image color developing device according to claim 1, wherein said second developing means comprises:

a magnetic core comprising a seven-pole magnet having an assymmetrical pattern, said magnetic core including a main developing pole including first and second adjacent poles elements of the same polarity opposite said photosensitive member; and a non-magnetic sleeve surrounding said magnetic core.

8. A latent image color developing device according to claim 5, wherein said photosensitive member is adapted to rotate at a predetermined speed in a first direction and wherein said non-magnetic sleeve is adapted to rotate at said predetermined speed in a direction opposite to said first direction.

9. A latent image color developing device according to claim 7, wherein said photosensitive member is adapted to rotate at a predetermined speed in a first direction and wherein said non-magnetic sleeve is adapted to rotate at said predetermined speed in a direction opposite to said first direction.

10. A latent image color developing device according to claim 1, wherein one of said first color toner and said second color toner includes a carrier having a density in the range of 1.7 to 4.0 g/cm$^3$.

11. A latent image color developing device according to claim 1, wherein said carrier is comprised of magnetic particles having a particle size in the range of 30 to 50 microns.

12. A latent image color developing device according to claim 1, wherein said scanning means comprises:

a light source for illuminating the document;

a first reading device for generating a first output signal corresponding to light image, thereon;

a second reading device for generating a second output signal corresponding to light image, thereon; and a dichroic mirror for reflecting to said first reading device to image thereon light reflected from the document having a specific color component and for transmitting to said second reading device to image thereon light reflected from the document which does not have said specific color component, said first output signal corresponding to one of said first and second color signal components and said second output signal corresponding to the other of said first and second color components.

13. A latent image color developing device according to claim 1, wherein said scanning means comprises:

a light source for illuminating the document;

a first reading device for generating a first output signal corresponding to light imaged thereon;

a second reading device for generating a second output signal corresponding to light imaged thereon;

a half mirror between said document and said first and second reading device for reflecting light reflected from the document toward the first reading devices and for transmitting to said second reading device light reflected from the document such that said first output signal generated by said first reading device corresponds to one of said first and second color signal components; and an optical filter between said first reading device and said half mirror for filtering said light reflected toward said first reading device by said half mirror such that said filtered light is imaged on said first reading device, said first output signal corresponding to the other of said first and second color signal components.

14. A latent color image developing method comprising the steps of:

forming electrostatic latent images on a latent image carrier;

developing a first set of said latent images in a first developing process with a first developer having a first toner of a first color;

developing a second set of said latent images in a second developing process comprising the substeps of providing a magnetic pole having a flux density greater than 500 guass proximate the latent image carrier;

providing a non-magnetic sleeve around the magnetic pole;

applying to the non-magnetic sleeve a two-component developer including a second toner of a second color and a magnetic carrier having a density less than 4.0 g/cm$^3$ to develop the second set of latent images; and transferring to a copy medium the developed first and second sets of latent images.

* * * * *